United States Patent [19]

Christian

[11] 4,307,647

[45] Dec. 29, 1981

[54] PERCUSSION MALLET

[76] Inventor: S. M. Bobby Christian, 531 N. East Ave., Oak Park, Ill. 60302

[21] Appl. No.: 202,024

[22] Filed: Oct. 29, 1980

[51] Int. Cl.[3] ..... G10D 13/00

[52] U.S. Cl. ..... 84/404; 84/422 S

[58] Field of Search ..... 84/404, 422 R, 422 C, 84/422 S

[56] References Cited

U.S. PATENT DOCUMENTS

| | | | |
|---|---|---|---|
| 846,503 | 3/1907 | Palmer | 84/422 S X |
| 1,042,904 | 10/1912 | Fraser | 84/422 C |
| 2,473,865 | 6/1949 | Dane | 84/404 |
| 2,853,912 | 9/1958 | Gladstone | 84/422 S |
| 3,998,123 | 12/1976 | Hinger | 84/422 S |

FOREIGN PATENT DOCUMENTS

| | | | |
|---|---|---|---|
| 1711747 | 11/1921 | United Kingdom | 84/422 R |

*Primary Examiner*—Lawrence R. Franklin

*Attorney, Agent, or Firm*—Cook, Wetzel & Egan, Ltd.

[57] ABSTRACT

An improved percussion mallet for musical instruments is described. The percussion mallet includes a shaft member, a tubular rubber shock absorber mounted on the head end of the shaft member, a wooden disc surrounding the shock absorber, and a rubber band secured to the outer surface of the wooden disc. These elements combine to produce a cleaner standard tone upon striking a musical instrument. In addition, the rubber band has three outer surfaces which enable the improved percussion to make either a forte or piano sound, depending upon the angle of the mallet as it impacts a musical instrument.

6 Claims, 3 Drawing Figures

FIG. 1
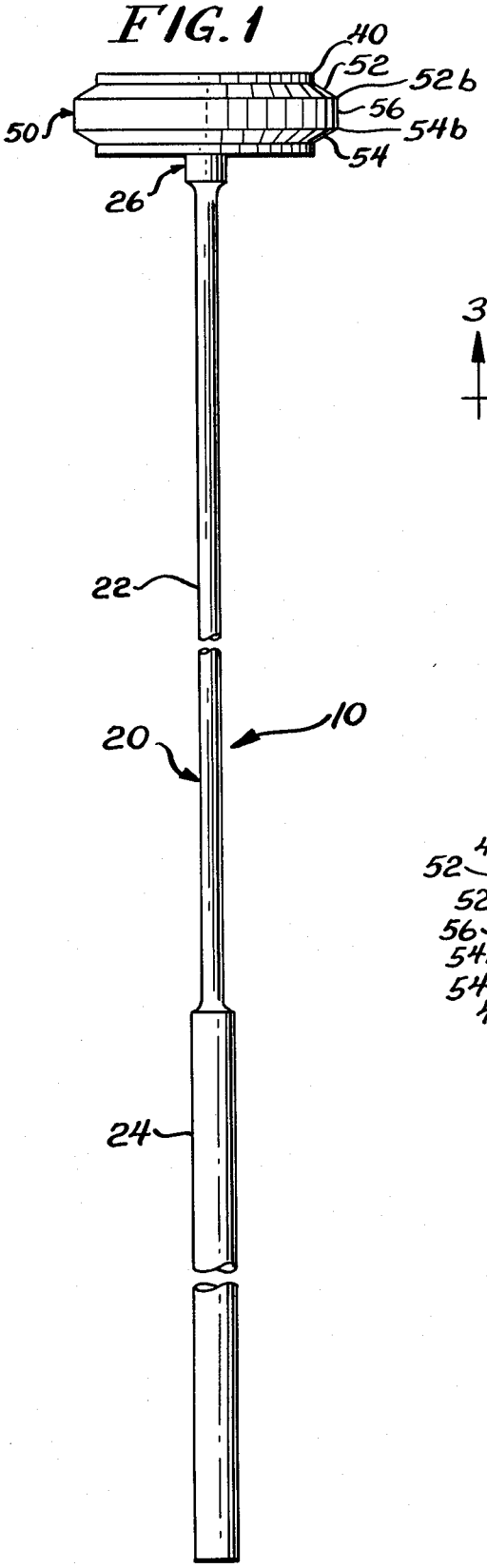
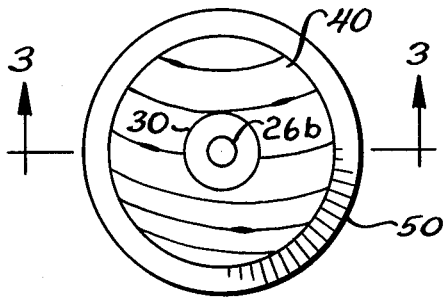
FIG. 2
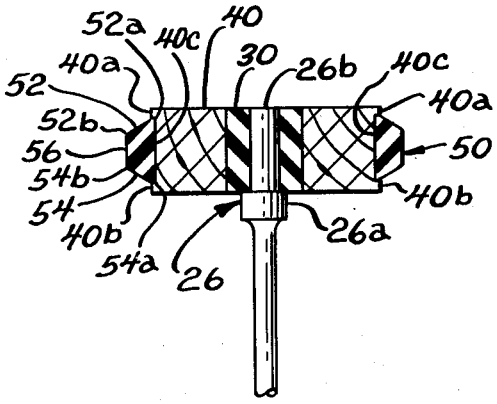
FIG. 3

PERCUSSION MALLET

BACKGROUND OF THE INVENTION

This invention relates to mallets for striking musical percussion instruments and, more particularly, to an improved percussion mallet.

Percussion mallets are used for vibraphones, marimbas, xylophones, and similar musical instruments. Previous percussion mallets include hammer heads constructed from combinations such as a rubber ball and wound cloth, a wooden base and a felt band, and a plastic ball and rubber sleeve. These mallets produce a "standard tone" upon impacting a percussion instrument. However, the "standard tone" is always preceded by a clunking sound attributable to the contact by the mallet with a bar of the percussion instrument before the "standard tone" of the bar is generated. This clunking sound is particularly noticeable and distracting in a recording studio. Prior percussion mallets are also limited in that they can only produce one volume. As a result, a player controls the volume by employing a higher stroke with a heavy, downward force for a forte passage and a lower stroke with a lighter, downward force for a piano passage.

A general object of the invention is to provide a percussion mallet for musical instruments which produces the "standard tone" without the clunking characteristics attributable to other percussion mallets.

Another object of the invention is to provide a percussion mallet for musical instruments which is capable of producing two different volumes, forte or piano, depending upon the angle at which the percussion mallet strikes the musical instrument, thereby eliminating the need to change stroke heights or playing force.

The present invention accomplishes these and other objects by providing a mallet having a head portion which includes a shock absorber, a wooden disc, and a circular band of rubber. The shock absorber consists of a rubber tube mounted on and affixed to the head end of the mallet handle. The wooden disc has a centrally positioned aperture which fits over and is glued to the outer surface of the rubber tube shock absorber. Finally, the circular band of rubber is affixed to the outer surface of the wooden disc. The circular band of rubber has a pair of converging symmetrical surfaces which extend outwardly and intersect with opposite ends of a third surface. The third surface and the edges formed by the intersecting of the third surface with the pair of converging surfaces establish the striking surfaces of the percussion mallet. A forte sound is created by striking the percussion instrument with the flat third surface, while a piano sound is created by changing the angle of the mallet so that either of the aforementioned edges strikes the percussion instrument.

DESCRIPTION OF THE DRAWING

Other advantages, features, and objects of the invention will become more apparent in the detailed description as shown in the accompanying drawing, in which:

FIG. 1 is a side elevational view of a percussion mallet with portions of the handle partially broken away.

FIG. 2 is a top view of FIG. 1.

FIG. 3 is a sectional view of FIG. 2 along the line 3—3 showing the details of the percussion mallet.

DESCRIPTION OF THE SPECIFIC EMBODIMENT

Referring to FIG. 1, the numeral 10 designates generally a percussion mallet including a shaft member 20, a rubber shock absorber 30, a wooden disc 40, and a circular band of rubber 50. The shaft member 20 is constructed of plastic or fiberglass. However, it is understood that the shaft member 20 may be constructed from any stiff, yet flexible, material. The shaft member 20 has a thin stem portion 22 extending from a handle end 24 to a head end 26. Referring to FIG. 3, the head end 26 of shaft member 20 includes a generally cylindrical shoulder **26*a* with an integral cylindrical support member 26*b*** mounted thereon.

The rubber tube shock absorber 30 fits around the outer surface of the support member **26*b* and onto the top surface of the shoulder 26*a*. It is understood that the shock absorber 30 may be constructed from any plyable and shock absorbing material. Glue is employed to keep the inner surface of the rubber tube shock absorber 30 affixed to the shoulder 26*a* and the support member 26*b*. In a similar manner, the wooden disc 40 fits around the outer surface of the rubber shock absorber 30. The disc 40 may also be constructed from any hard material. Again, glue is employed to keep the inner surface of the wooden disc 40 affixed to the outer surface of rubber shock absorber 30**.

The wooden disc 40 has a pair of annular flanges **40*a* and 40*b* which border and extend outwardly beyond the outer surface 40*c* of the wooden disc 40. Accordingly, the rubber band 50 must be slightly stretched to fit over one of the flanges 40*a* or 40*b* before it retracts and lodges against the outer surface 40*c*. As before, glue is employed to keep the rubber sleeve 50 affixed to outer surface 40*c* of the wooden disc 40**.

The rubber band 50 has three outer surfaces 52, 54, and 56, respectively. The surfaces 52 and 54 have inner edges **52*a* and 54*a* which abut annular flanges 40*a* and 40*b*, respectively. The surfaces 52 and 54 converge as they extend outwardly and intersect with the outer surface 56 to form outer edges 52*b* and 54*b*. The outer surface 56 is concentric and parallel to the shaft member 20. In addition, it has an impact surface approximately a quarter inch wide in the preferred embodiment. It is understood that the band 50** may be formed from any material capable of producing a musical tone on a percussion instrument.

The three outer surfaces 52–56 of the rubber band 50 form the striking surfaces upon which the cleaner standard tone is produced. Depending upon the angle in which the mallet makes contact with the bar of a musical instrument, two different volumes can be attained. A forte (loud) sound is produced when the surface 56 impacts the bar. Alternatively, a piano (soft) sound is generated on the musical instrument when either outer edge **52*b* and 54*b*** makes contact with the bar.

The rubber shock absorber 30, the wooden disc 40, and the rubber band 50 each contribute to the cleaner sound produced by this invention. In particular, the vibrational force created by the impact of the rubber band 50 upon the bar of a musical instrument is transmitted from the rubber band 50 to the rubber shock absorber 30 via the wooden disc 40. As the vibrational force travels from the rubber band 50 to the rubber shock absorber 30, some of the force is absorbed by the rubber band 50 and the wooden disc 40. The remaining force is then absorbed by the rubber shock absorber 30 before the force can be further transmitted to the handle 20. Accordingly, the clunking sound characteristic is eliminated, leaving only the pure standard tone to be more cleanly heard. This cleaner sound is particularly desirable in a recording studio environment.

In the above description, specific details of an embodiment of the invention have been provided for a thorough understanding of the inventive concepts. It will be understood by those skilled in the art that many of these details may be varied without departing from the spirit and scope of the invention.

What is claimed is:

1. An improved percussion mallet for striking musical instruments comprising:

a shaft member having a head end and a handle end;

shock absorber means being resiliently yieldable and having a central aperture therethrough for mounting upon said head end;

a disc having a central aperture for engaging the outer surface of said shock absorber means; and a resiliently yieldable band having an inner surface force fit over and against the outer surface of said disc, said band having a pair of converging outer surfaces extending outwardly from said inner surface and intersecting with a third outer surface to form a pair of annular edges, said third outer surface being concentric and parallel to said shaft member.

2. The improved percussion mallet of claim 1 wherein said head end includes a generally cylindrical shoulder and a cylindrical support member extending from the center of said shoulder, said shock absorber means mounted around said support member and on top of said shoulder.

3. The improved percussion mallet of claim 1 wherein said shock absorber is a tubular rubber sleeve.

4. The improved percussion mallet of claim 1 wherein said disc is a wooden wheel having a pair of flanges bordering the outer surface thereof.

5. The improved percussion mallet of claim 4 wherein said resiliently yieldable band fits against the outer surface of said wooden wheel between said pair of flanges.

6. The improved percussion mallet of claim 1 wherein said resiliently yieldable band is constructed from rubber.

* * * * *